US008362963B2

(12) United States Patent
Rakotoarisoa et al.

(10) Patent No.: US 8,362,963 B2
(45) Date of Patent: Jan. 29, 2013

(54) SATELLITE TRANSMISSION ANTENNA AND SATELLITE-BASED MOBILE TELECOMMUNICATION STATION

(75) Inventors: Bruno Rakotoarisoa, Gif-sur-Yvette (FR); Michel Gomez Henry, Ploubalay (FR)

(73) Assignee: Eversat, Orsay (FR)

( * ) Notice: Subject to any disclaimer, the term of this patent is extended or adjusted under 35 U.S.C. 154(b) by 161 days.

(21) Appl. No.: 12/676,249

(22) PCT Filed: Sep. 5, 2008

(86) PCT No.: PCT/FR2008/001240

§ 371 (c)(1), (2), (4) Date: Mar. 3, 2010

(87) PCT Pub. No.: WO2009/066019

PCT Pub. Date: May 28, 2009

(65) Prior Publication Data

US 2010/0171677 A1 Jul. 8, 2010

(30) Foreign Application Priority Data

Sep. 5, 2007 (FR) ..... 07 06215

(51) Int. Cl.
*H01Q 3/00* (2006.01)

(52) U.S. Cl. ..... 343/757; 343/834; 343/881

(58) Field of Classification Search ..... 343/757, 343/878, 880–882, 840, 915, 834
See application file for complete search history.

(56) References Cited

U.S. PATENT DOCUMENTS

| | | | | |
|---|---|---|---|---|
| 4,771,293 | A | 9/1988 | Williams et al. | |
| 5,528,250 | A * | 6/1996 | Sherwood et al. | 343/711 |
| 5,554,998 | A * | 9/1996 | Sherwood et al. | 343/881 |
| 6,388,614 | B2 * | 5/2002 | Radonic | 342/359 |
| 6,947,740 | B2 * | 9/2005 | Snell | 455/427 |
| 2002/0018016 | A1 | 2/2002 | Radonic | |
| 2002/0025788 | A1 | 2/2002 | Nitta | |

OTHER PUBLICATIONS

International Search Report dated May 6, 2009.

* cited by examiner

*Primary Examiner* — Hoang V Nguyen
(74) *Attorney, Agent, or Firm* — Sofer & Haroun, LLP

(57) ABSTRACT

A satellite antenna for transmitting and receiving an electromagnetic signal has at least one parabolic reflector, a source arm, and a high-power amplifier, in which antenna the high-power amplifier includes a traveling wave tube on the source arm and a high-voltage power supply off the source arm and adapted to supply power to the tube. A satellite mobile telecommunications station includes such a satellite antenna and a storage structure into which the antenna is folded and in which the high-voltage power supply sits.

14 Claims, 6 Drawing Sheets

FIG.8
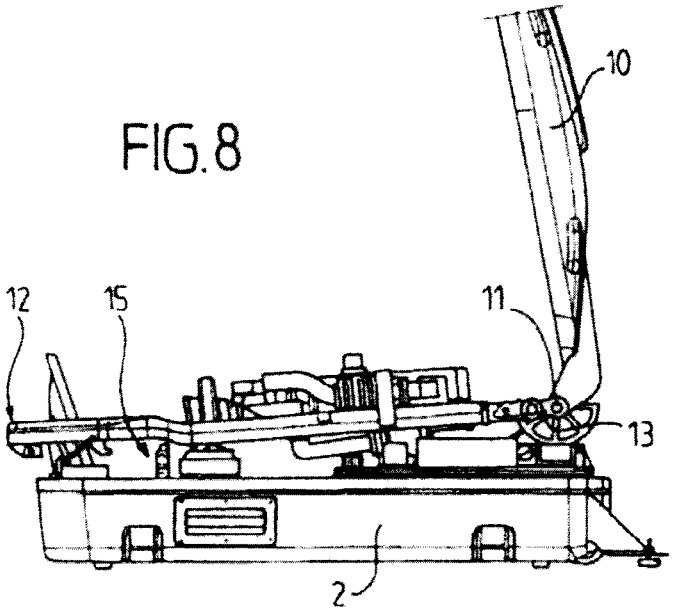
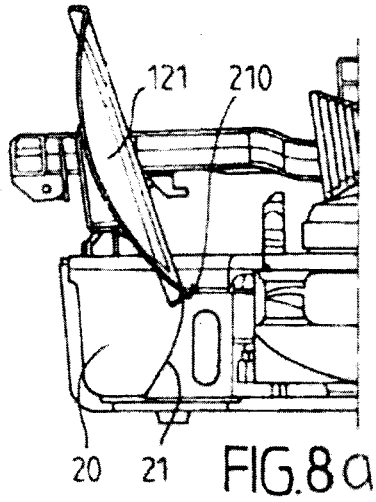
FIG.8a
FIG.9
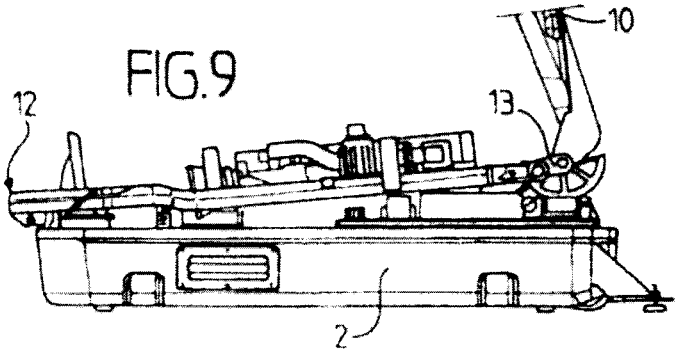
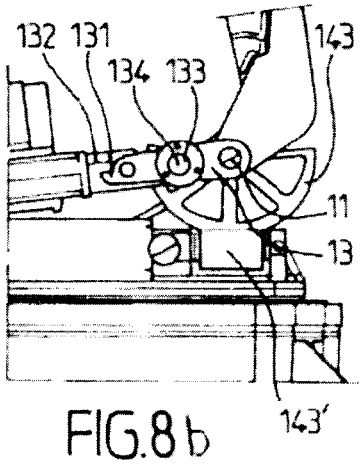
FIG.8b
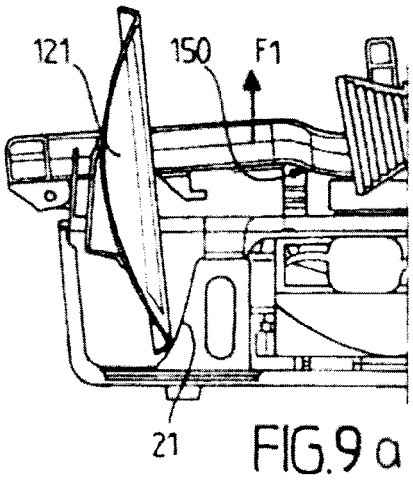
FIG.9a
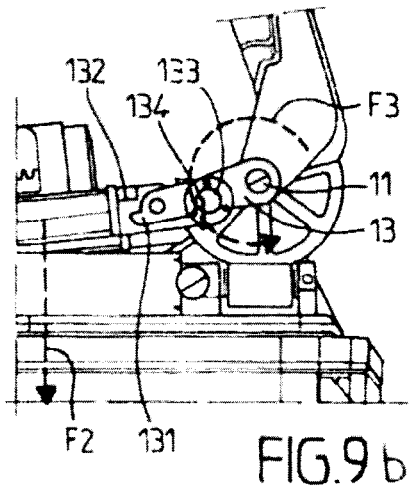
FIG.9b

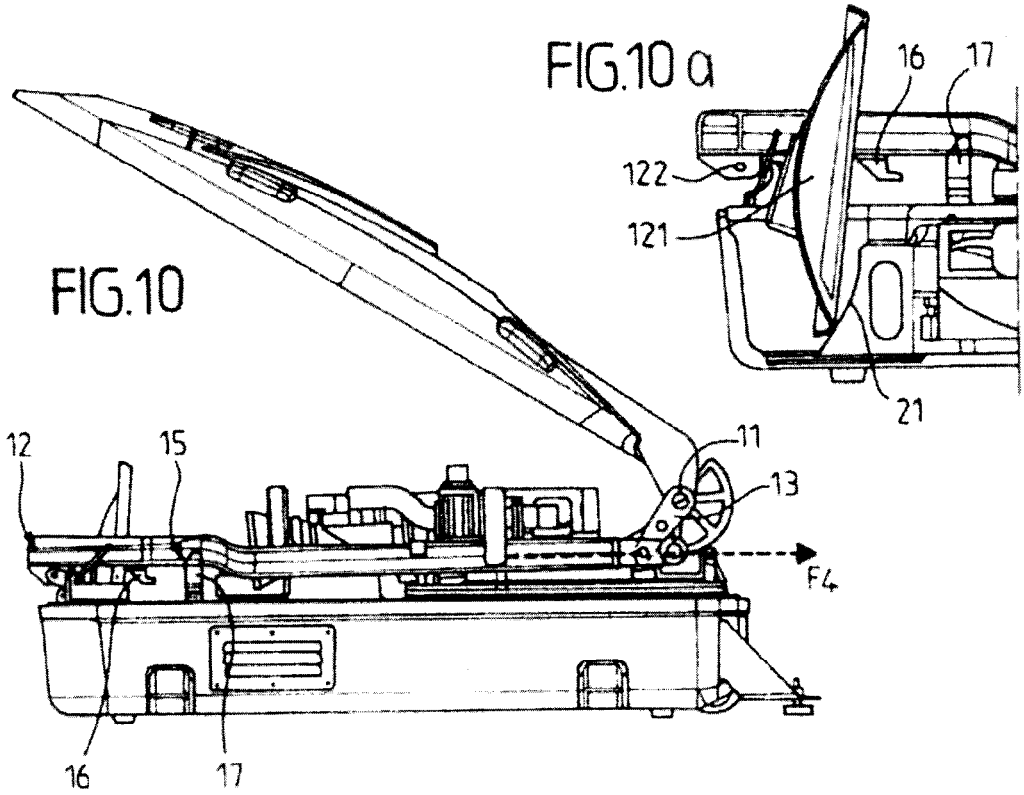
FIG.10 a
16
17
122
121
21
FIG.10
12
15
11
13
F4
16
17
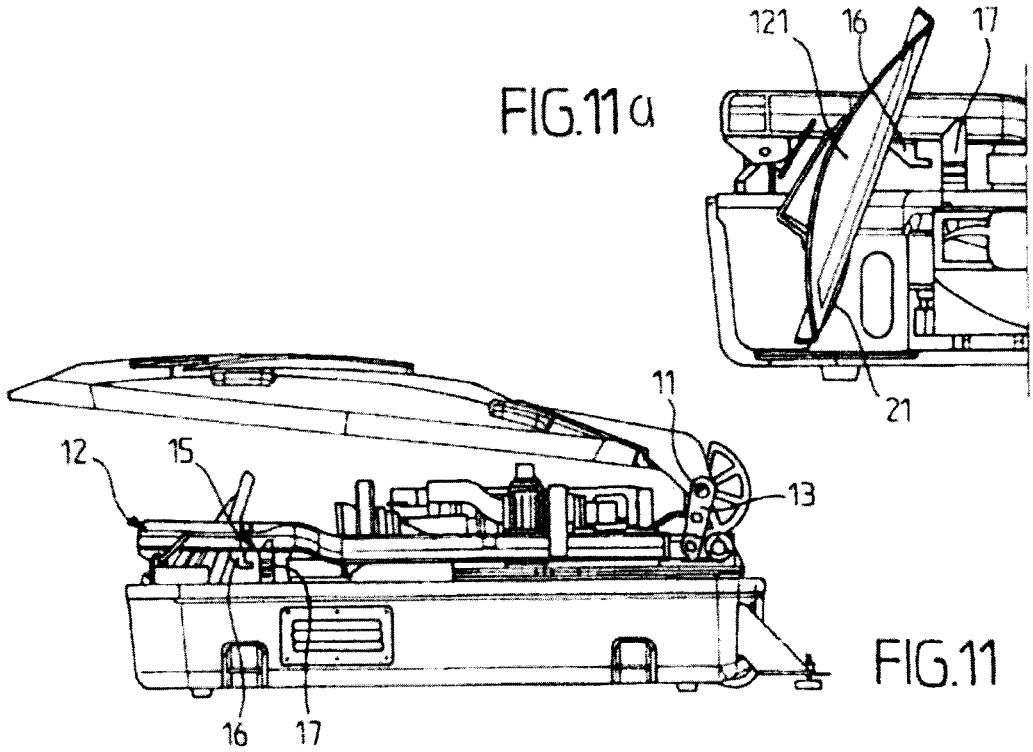
121
16
17
FIG.11 a
21
11
12
15
13
16
17
FIG.11

SATELLITE TRANSMISSION ANTENNA AND SATELLITE-BASED MOBILE TELECOMMUNICATION STATION

RELATED APPLICATIONS

This application is a National Phase Application of PCT/FR2008/001240, filed on Sep. 5, 2008, which in turn claims the benefit of priority from French Patent Application No. 07 06215, filed on Sep. 5, 2007, the entirety of which are incorporated herein by reference.

BACKGROUND

1. Field of the Invention

The invention relates to the field of satellite transmission antennas, possibly provided with receiving capacity. Such antennas are used in satellite broadcasting systems and they comprise a primary reflector and a source arm generally both connected to a support. The source arm may also be equipped with a secondary reflector.

The invention also relates to a satellite mobile telecommunications station. Satellite mobile telecommunications stations suitable for remote news gathering have recently become available, either transported in flight cases (Swe-Dish Fly-Away terminals, for example) or mounted on a vehicle (Swe-Dish Drive-Away terminals, for example). Such stations also have receiving capacities providing a bidirectional link.

2. Description of the Related Art

The uplink connection from a sender station to the satellite requires a high radiated power level in order for the signal rebroadcast by the satellite to be received and used correctly. To satisfy the required transmission power, in particular under extreme conditions (edge of satellite coverage, poor propagation channel), the sender station transmission system is provided with high-power amplifiers (HPA). Note that receive-only satellite antennas do not suffer from this power problem.

In satellite mobile telecommunications stations, these HPAs are in the form of a single unit combining one or more amplifier components (called active components, for example power transistors or traveling wave tubes (TWT)) and an appropriate power supply to provide the necessary and appropriate electrical power to the active components. These components are bulky and heavy if a power of tens or hundreds of watts is required, the resulting HPA weighing more than ten kilograms. This weight imposes high structural stresses on the elements supporting these components.

The invention also relates to the use of high-power amplifiers (HPA) based on traveling wave tubes (TWT) with a transmission power of at least 100 watts (W). A TWT-based HPA consists of a TWT subsystem and a high-voltage power supply subsystem producing voltages of several kilovolts. Generally designed as a one-piece unit, a TWT-based HPA incorporates a switch-mode power supply unit accepting direct current (DC) voltages (generally in the range 12 volts (V) to 48 V) or alternating current (AC) voltages (generally in the range 90 V to 265 V at 50 hertz (Hz) to 60 Hz) and supplying the high voltage necessary for the TWT to operate correctly.

It is known in the art to use fixed satellite antennas in which the HPAs are installed on the source arm of the antenna. The source arm is then sized appropriately to ensure the stiffness of the assembly and to maintain the centering of the secondary reflector or horn, such sizing sometimes being associated with the use of retaining rods or cables that relieve the source arm of the forces that are applied to it. These satellite antennas quickly become bulky and too heavy for mobile applications, in particular to conform to transportation standards such as those of the International Air Transport Association (IATA).

OBJECTS AND SUMMARY

An object of the invention is to propose an antenna in particular a source arm, of simplified mechanical design.

Given this background, another approach to satellite mobile telecommunications stations has been adopted. Documents EP-1 465 288, U.S. Pat. Nos. 4,771,293, and 6,573,871 disclose satellite mobile telecommunications stations each comprising a satellite antenna for transmitting an electromagnetic signal, and comprising at least:

a parabolic primary reflector;

a source arm; and high-power amplifier means.

The primary reflector is the main reflecting surface, which for reception concentrates waves broadcast by a satellite towards a source antenna mounted on the source arm, and for transmission broadcasts by reflection waves emitted by this source antenna towards the satellite. The primary reflector may be formed of one or more reflector portions (also known as petals) that, in use, are held in contact with one another to form the primary reflecting surface. The expression "parabolic reflector" means any reflector of a satellite antenna or any portion of a reflector made up of one or more portions in contact with one another forming a reflecting surface having substantially parabolic curvature, whatever the outline (external shape) of the reflector: circular, substantially lozenge-shaped, ellipse-shaped, etc.

The source arm defines the mechanical part responsible for holding the components that illuminate the primary reflector, notably the secondary reflector, when present, the radiating source (horn, patches, array of such elements), and the systems and components associated with the source of radiation (filters, orthomode feed, HPA, LNA (low-noise amplifier), LNB (low-noise block downconverter), etc.). In many configurations the source arm extends from a fastening point (usually at the periphery of the primary reflector) towards the focal point of the primary reflector (at the free end of the source arm). This focal point (situated approximately 500 millimeters (mm) from the center of the primary reflector for example) constitutes the primary focus of the antenna, at which the source antenna is placed, either in the form of a source of radiation or in the form of a secondary reflector reflecting radiation from or towards a source that is farther away. The source arm may be cantilevered from its fastening point, which is why attempts are made to limit the load applied to it.

In vehicle-mounted satellite mobile telecommunications stations (known as drive-away stations) with an HPA mounted on the source arm, the source arm is strengthened to support these components. If there is a mechanism for driving the source arm, it is also strengthened and bulky.

In contrast, the source arms of most transportable (fly-away) satellite mobile telecommunications stations known in the art are provided with respective horn antennas (source antenna), possibly with respective secondary reflectors. The HPA is positioned externally to the reflector elements and the source arm of the antenna and is connected to the horn antenna by a waveguide. In this configuration, the source arm is less heavily loaded and may therefore be less bulky. The drawbacks of this configuration are, firstly, deterioration of the signal and loss of power before transmission caused by ohmic losses within the waveguide and, secondly, increased bulk of the support part of the antenna (excluding the source arm and reflector). This loss of power must be compensated by a more powerful HPA and therefore by an additional load and an additional volume, compromising transportability. A more powerful HPA is also more costly.

Another object of the invention is therefore to improve the transmission performance of these antennas using the same HPA and without larger source arms, i.e. retaining a simple mechanical design of the source arm conducive to transportation and its motor-driven pointing towards the satellite.

This simple mechanical design of the source arm is also advantageous in itself: if a motorized mechanism for driving the antenna is provided, the smaller the load to be motorized, the smaller this mechanism, and the less energy it consumes. The mechanism may be a two-axis or a three-axis positioner for adjusting the azimuth, polarization, and elevation of the antenna, an actuator for deploying/folding the antenna, or possibly a module combining the capabilities of an actuator and a 2-axis or 3-axis positioner.

Using a waveguide to connect the antenna to the HPA is also undesirable for several reasons.

Firstly, rotary joints or waveguides must be used between the horn antenna and the waveguide to provide effective wave guidance when the source arm is rotated to adjust the elevation of the antenna, for example. Such rotary joints or waveguides are costly and, when integrated into the system, represent an additional weight load on the source arm.

Another object of the invention is to dispense with such rotary joints or waveguides in order to propose steerable antennas of low cost.

Secondly, if there is to be no risk of degrading the transmission of guided waves, the waveguide must not be too curved. Consequently, the waveguide that extends from the source arm towards the external HPA forms a bend at the base of the source arm, causing a problem during manipulation operations, for example when folding the antenna. The volume occupied by this bend and its movement also compromise the aim of producing a compact system conforming to transportation standards such as IATA standards. Furthermore, the stiffness of the guide generates resisting forces on a mechanism for driving the antenna (azimuth, polarization, or elevation adjustment, or folding). A more powerful and more robust motorized mechanism must then be used, to the detriment of the weight and the volume of the system.

Thus another object of the invention is to dispense with the waveguide at the connections between the source arm and the support in order to limit the inconvenience and resisting forces caused by the waveguide. This results in a simplified drive mechanism and a saving in volume and weight.

At least one of the above objects is achieved by the present invention by separating the high-voltage power supply and the TWT of the HPA, the TWT being placed on the source arm whereas the high-voltage power supply is preferably placed on the support of the source arm and the reflector. A configuration of this kind enables the use of flexible electrical cables between the high-voltage power supply and the TWT and the use of a flexible coaxial cable (rather than a rigid waveguide) to feed the low-power signal to the TWT, the coaxial connection being compatible with the transmission of a low-power signal. Consequently, the TWT of the HPA is kept as close as possible to the primary focus (source) of the antenna, generating minimum power loss and limiting the additional load imposed on the source arm. A TWT rated at 200 W weighs approximately 2 kilograms (kg). Consequently, the source arm and the mechanisms for adjusting the arm and the antenna can have reasonable dimensions compared to a source arm having to support the weight of the TWT and its high-voltage power supply (around 10 kg).

To this end, the invention provides firstly a satellite antenna for transmitting an electromagnetic signal, and comprising at least:

a parabolic primary reflector;

a source arm; and high-power amplifier means including at least one traveling wave tube with a transmission power of at least 100 watts on said source arm and a high-voltage power supply off said source arm and adapted to supply power to said traveling wave tube.

TWT amplifiers routinely offer a transmission power of several hundred watts. A transmission power of 200 W is compatible with a satellite link that is effective under difficult conditions, for example if the antenna is situated at the edge of the coverage of the satellite, if the target satellite is old and of low sensitivity or if meteorological conditions are unfavorable.

According to the invention, the TWT is carried by the source arm as close as possible to the source antenna (horn antenna, patch antenna, or any other device consisting of an assembly of radiating elements (RE), for example an array of REs), where applicable coupled to a secondary reflector. A TWT weight of approximately 1 kg to 2 kg does not require a significant increase in the dimensions of the source arm, since the length of such an arm is generally of the order of 50 centimeters (cm) for a 70 cm diameter reflector.

The high-voltage power supply, weighing of the order of 5 kg to 10 kg, is not carried either by the source arm or by any mobile component of the antenna (for example the primary reflector). The high-voltage power supply is preferably secured to a support adapted to receive the mobile source arm and the mobile primary reflector. A bundle of electrical cables runs along the source arm and the means connecting the source arm/primary reflector and the support and connects the high-voltage power supply to the TWT. The mobile means connecting the source arm and the primary reflector to the support are of the 2-axis or 3-axis positioner type (elevation, azimuth, and where applicable, polarization).

In one embodiment of the invention said parabolic primary reflector and the source arm are mounted to move relative to a support between a position of use and a storage position. The storage position may for example be such that the primary reflector and the source arm are folded into a storage structure that acts as the support on which the mobile reflector and the mobile source arm are mounted.

In one embodiment of the invention, the primary reflector is formed of a plurality of removable portions known as petals and said storage structure is adapted to house said portions when removed when the antenna is in the storage position.

To minimize the resulting overall size of the antenna in the folded storage position, the TWT is arranged on said source arm so that, in the storage position, it occupies at least part of the space defined by the parabolic curvature of the primary reflector. The space defined by the curvature of the reflector is to be understood as the space contained between the curved reflecting surface of the reflector (or central petal if the reflector consists of a plurality of removable petals, only the central petal generally remaining in place in the storage position) and the plane bearing on the edge of the reflector, given that the reflector may be of a non-circular outline.

In prior art systems the source antenna (horn antenna and/or secondary reflector) come up against the primary reflector in the folded storage position. This prevents use of the space between these two components, notably the hollow space formed by the curved primary reflector. The invention uses this space formed by the primary reflector to store the TWT.

In particular, said TWT is positioned on said source arm substantially on the side facing the primary reflector in the storage position.

In particular, said TWT is arranged on said source arm so as substantially to face the central part of said primary reflector in the storage position.

In one embodiment of the invention, said TWT is positioned on one side of said source arm and is inclined so as to follow the inclination of the facing primary reflector. The lateral position of the TWT leaves the center of the source arm free for the horn antenna and secondary reflector components. Inclining the TWT to follow the inclination of the primary reflector at the same location optimizes use of the storage space.

The source arm and the primary reflector may have multiple capacities for rotation, notably in elevation (both components rotating about the same horizontal axis), in azimuth (both components rotating about the same vertical axis), and/or in polarization (rotation of the radiating element [patch, horn, array] with its orthomode feed, if it has one).

In particular, said source arm is mounted to rotate via cam means secured to said primary reflector. The cam effect is produced firstly by the rotation axis of the primary reflector (and the cam means) and secondly by the parallel and separate rotation axes of the source arm and the cam means. The source arm is freely rotatable relative to the cam means.

In particular, said cam means are arranged so that said source arm moves in translation between said position of use and said storage position when said primary reflector is folded. If this movement in translation moves the source arm towards the folding mechanism (the reflector rotation axis), then the folded system is more compact.

Furthermore, the cam means are arranged so that the source arm rotates relative to said support when adjusting the elevation of said primary reflector.

To provide both the movement in translation in the folding phase and the rotation movement in use, the cam means comprise means for driving said source arm in rotation when said primary reflector is rotated relative to said support. In particular, said drive means include an abutment provided on the cam and a corresponding abutment provided on the source arm so that when the cam is driven in rotation at the same time as the primary reflector, the two abutments come into contact and drive the source arm.

To prevent loss of contact between the two abutments and/or tilting of the source arm in the presence of wind, retaining means are provided to maintain the contact between said abutments. In particular, said retaining means include a catch on the source arm and a corresponding opening on the cam means, the catch being engaged in the opening when the station is in use. Accordingly, these retaining means hold the source arm and said cam means in the same relative position when said antenna is in use. Maintaining the same relative position preserves the stiffness of the cam plus source arm assembly and thus ensures efficacious rotation of the source arm.

In an advanced embodiment of the invention, the antenna further includes a secondary reflector rotatably mounted on said source arm. In the prior art, the secondary reflector is substantially perpendicular to the source arm. When the antenna is folded by rotation of the primary reflector, the second reflector is immediately substantially perpendicular to the primary reflector, leading either to a collision between the two reflectors or to a limitation on the movement of the source arm towards the primary reflector. According to the present invention, said support includes guide means adapted to guide rotation of said secondary reflector during said movement in translation of the source arm. Because the movement in translation of the source arm is coupled to the secondary reflector guide means, said means are progressively inclined as the antenna is folded towards its storage position. In this position, the secondary reflector is no longer perpendicular to the primary reflector. The primary reflector may therefore be closer to the source arm. The antenna in the storage position thus gains in terms of compactness.

Where appropriate, said guide means formed on said support, for example a rail, have a curved profile, said second reflector being adapted to come into contact with said profile during unfolding/folding of the antenna.

In satellite mobile telecommunications stations it is necessary to retain the various components securely during transportation in order to prevent them being damaged by shock and vibration. To this end, the satellite antenna further includes means for fastening/immobilizing said source arm in the storage position. In particular, said fastener means include a first fastener member disposed on said source arm and a second fastener member secured to said support, said first and second fastener members being adapted to cooperate with each other during said movement in translation of the source arm.

In particular, said first fastener member is a finger secured to said source arm and said second fastener member is an opening in said support adapted to receive said finger during the movement in translation. During folding, a first phase of rotation of the cam brings the source arm and the finger onto the axis of the opening formed in the support. During the movement in translation of the source arm, the finger is engaged in the opening and prevents the source arm from moving. This increases the resistance of the antenna to shock and vibration by preventing the source arm from moving relative to the support.

The invention further provides a satellite mobile telecommunications station including an antenna as defined above and a cover removably engaged with said support, said support and said cover being adapted to form a structure for storing said antenna in the storage position.

The use of high-strength materials such as carbon fiber for the storage structure imparts a shock protection function to the structure.

BRIEF DESCRIPTION OF THE DRAWINGS

The invention can be better understood in the light of the following detailed description and the appended figures, in which:

FIGS. 8 to 12 show the satellite mobile telecommunications station at various stages of folding it from its operating position to its storage position;

FIGS. 7*a* to 12*a* show the position and the rotation of the secondary reflector in the corresponding positions from FIGS. 7 to 12;

FIGS. 8*b* and 9*b* are lateral views to a larger scale of the cam means in the corresponding positions from FIGS. 8 and 9;

DETAILED DESCRIPTION

The same reference numbers are used to refer to the same items in the various figures and the following text.

The example described here relates to a satellite mobile telecommunications station conforming to the IATA international transport standard (weight less than 32 kg, combined width, length, and height less than 1580 mm). In this example the station 1 sends and receives on satellite links in the Ku frequency band (it is equally possible to use other frequency bands: X, Ka, C, etc.).

Figure 1:
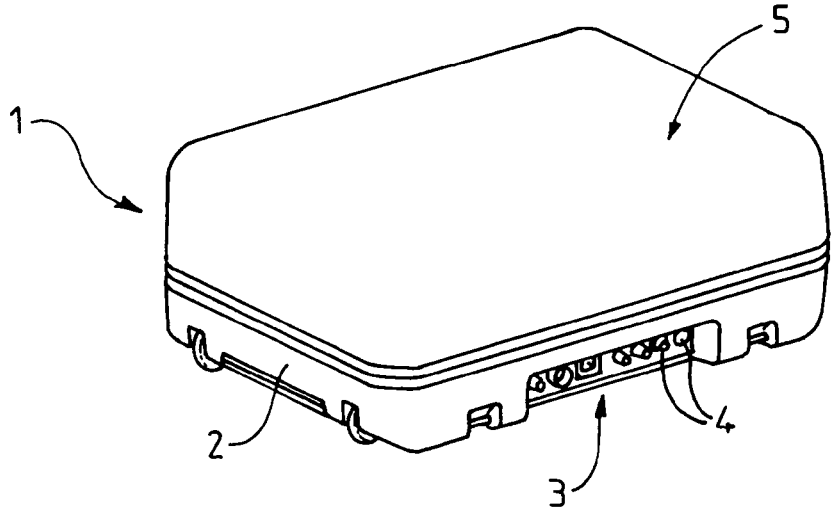
FIG. 1 shows a satellite mobile telecommunications station of the present invention in its folded storage and transport position.

Referring to FIG. 1, the folded station 1 has a substantially rectangular base 2 having an interface 3 consisting of electrical and/or electronic connectors 4 for connecting the station to external equipment, for example an electrical power supply (mains) or a laptop computer.

The station 1 also has a lid 5 of complementary shape to the base 2. The base 2 and the lid 5 are of carbon composite material and form the lower and upper shells of a structure for protecting internal electronic and mechanical components in a folded position of the station. A closure system (not shown) is provided for closing the protective structure.

A satellite mobile telecommunications (send and receive) station includes two separate systems that are distinguished as follows in the remainder of the description:

- the antenna system, which includes the antenna, power amplifier components (transmission), and low-noise amplifier components (reception);
- the base-band system, which includes components for processing the signals transmitted and received. These components include modulation and demodulation components, encryption components (if necessary), multiplexing and demultiplexing components (if necessary), other routers (for data signals), and finally upconverters for uplink transmission (to the satellite) and downconverters for downlink transmission (from the satellite). This base-band system is not described in more detail below since the invention relates to the antenna system. It can be incorporated in the support of the antenna system or housed in a flight case separate from the antenna system.

Figure 2:
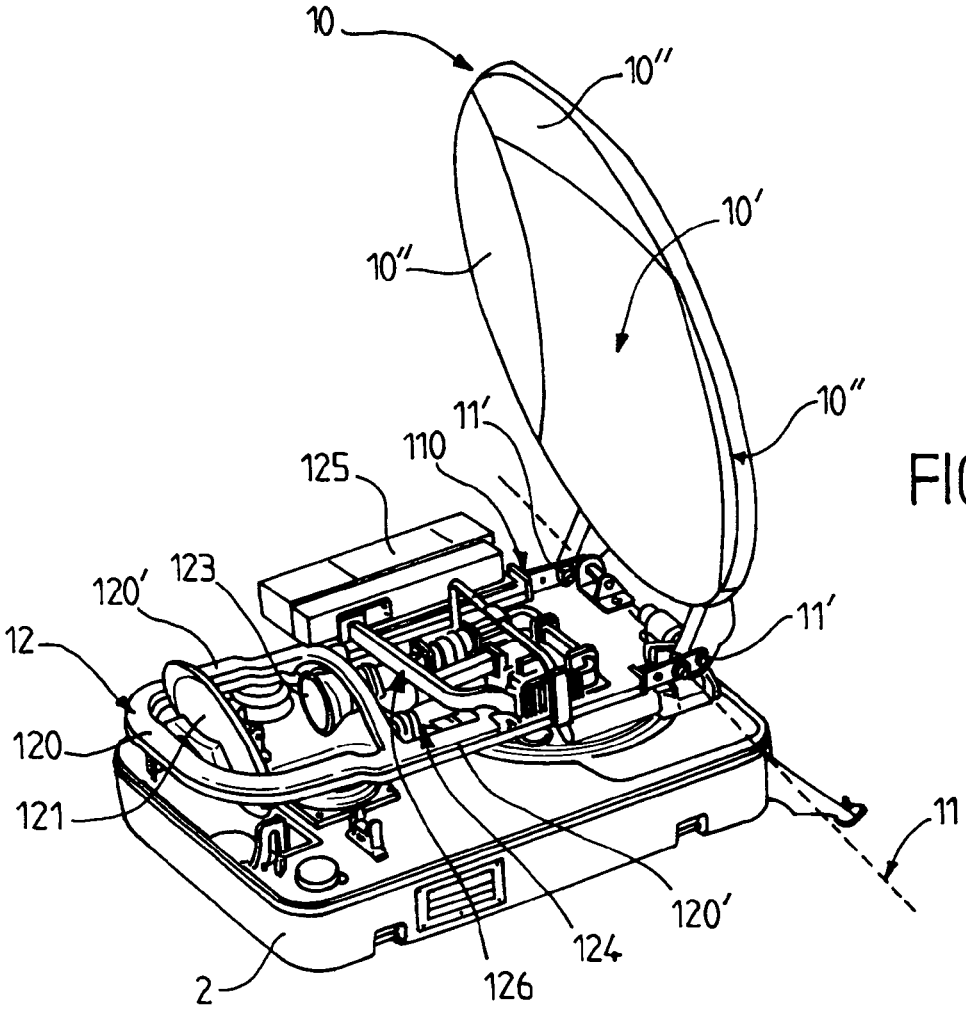
FIG. 2 is a view in elevation of the same satellite mobile telecommunications station when deployed, having the sighting directions azimuth=0° and elevation=20°.

In FIG. 2, the station 1 is in the unfolded operating position with the following parameters: azimuth=0° and elevation=20°.

The base 2 can include (concealed inside it and not shown) a miniature PC and components of the antenna system such as a high-voltage power supply unit for an HPA, a power supply unit for the electronics, a dedicated electronic circuit card, a KU to L band converter, an L band to KU band converter, a beacon receiver, a microwave switching card, a 2-axis inclinometer, and a compass.

A carbon fiber parabolic primary reflector 10 is articulated to the base 2 on two pivots 11' to rotate about a horizontal axis 11. The primary reflector 10 consists of a central petal 10' secured to the pivots 11' that articulate it about the horizontal axis 11 and three removable petals 10" that are attached to it by attachment means that are not shown, for example by hooks. The focal length of the primary reflector 10 is approximately 500 mm.

Figure 3:
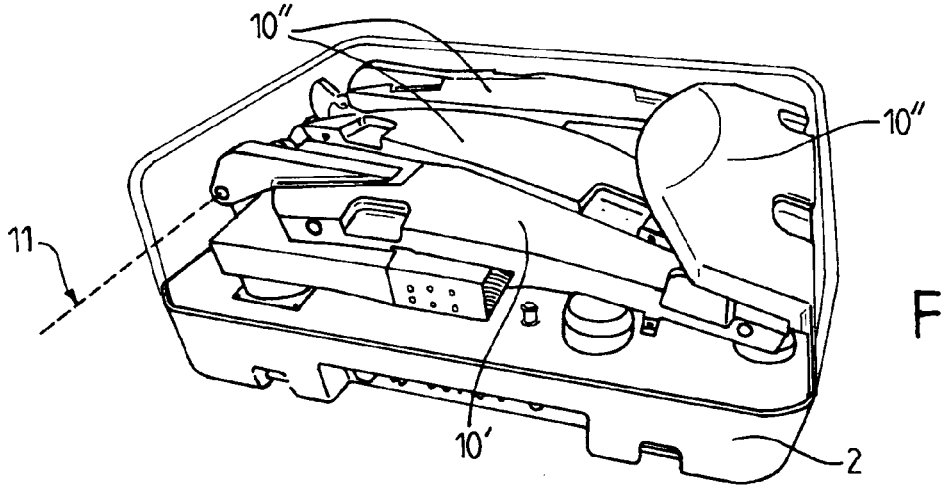
FIG. 3 is a more detailed view of the folded satellite mobile telecommunications station from FIG. 1, the protective cover being shown as if transparent.

FIG. 3 shows the satellite mobile telecommunications station in the folded configuration without the lid 5 and shows how the removable petals 10" are stowed when they are not attached to the folded central petal 10'.

A source arm 12 is also articulated about the axis 11 by the same two pivots 11' as the primary reflector 10. The source arm 12 is formed of a continuous hollow carbon fiber structure 120 comprising two parallel rectilinear arms 120' connected together by a bridge at one end to provide stiffness, and connected at their other end by cams 13 to rotate about the axis 11. The cams 13 are described in more detail below. The source arm 12 has a length of approximately 700 mm and supports part of the antenna system. In particular, the source arm 12 supports at its end opposite the elevation rotation axis 11 an elliptical or quasi-elliptical secondary reflector 121 articulated about a horizontal axis 122 parallel to the axis 11. The source arm 12 also supports a radiating element (here a horn 123 adapted to receive electromagnetic waves from or to emit electromagnetic waves towards the secondary reflector 121), the power amplifier/low-noise amplifier components 124 of the send/receive system and in particular the TWT 125 rated at 200 W and having dimensions of 290×70×45 mm excluding its cooling components (fan and heatsink). Other components of the send and receive systems are also supported by the source arm 12 but are not described in detail here: polarization axis drive system (motor, coder, limit switches), orthomode feed, RX filter, LNA, polarization rotary joint, harmonic filter, TX filter, coupler, isolator, connection guides, guide support structures, etc.

The TWT 125 is connected to a high-voltage power supply unit (not shown) inside the base 2 by a flexible electrical cable (not shown) running along the rectilinear arms 120' of the source arm and past the articulations 11'. This power supply unit is screwed to cylindrical mounting blocks providing vibration and shock resistance in the bottom of the base 2.

The power amplifier/low-noise amplifier components 124 are connected to the base-band components by a coaxial cable (not shown) near the pivots 11' for rotation about the axis 11. Using a coaxial cable, which is more flexible than a waveguide, reduces the resisting forces to which the pivots 11' are subjected.

Thus the signal generated by the base-band system is applied to the satellite mobile telecommunications station, which changes its frequency band (from band L to band KU) and then sends it to the TWT 125 via the coaxial cable, is amplified by said TWT 125 (which is supplied with power by the high-voltage power supply unit in the base), is then sent in the form of electromagnetic waves via a waveguide 126 to the horn 123, and is then reflected towards the target satellite by the secondary reflector 121 and the primary reflector 10 in succession. The reverse path for the received signal is identical except that the received signal is processed conventionally by the low-noise amplifier 124 (not by the HPA) and transposed into the L band by the KU band to L band converter inside the case before being sent to the base-band system outside the case via a coaxial cable.

Figure 4:
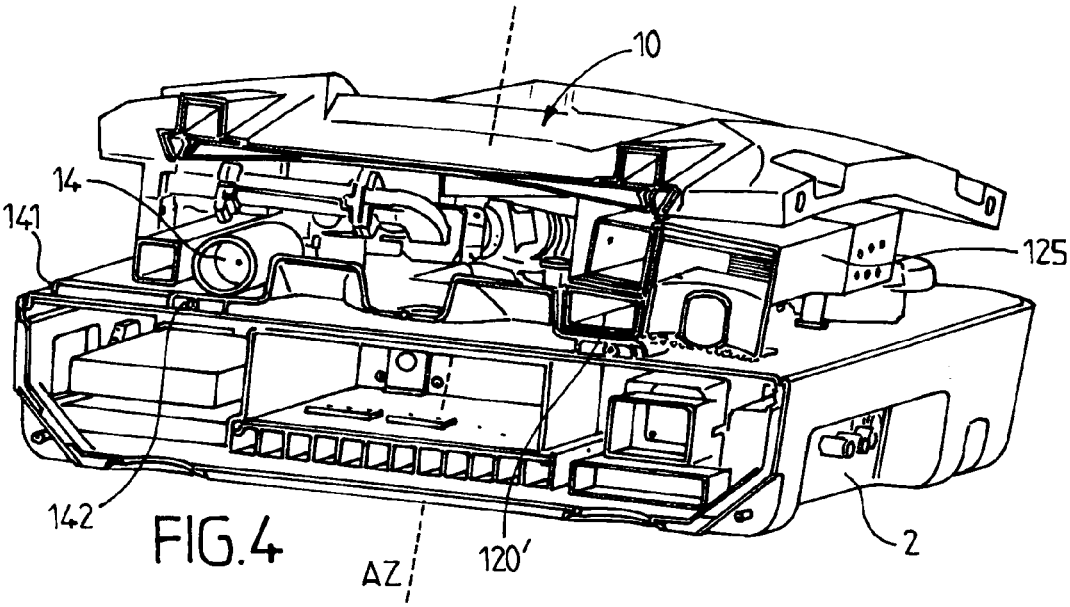
FIG. 4 represents a cross-section of the rear of the satellite mobile telecommunications station in the folded position, showing details of the integration of the TWT and the sighting adjustment mechanisms.

The turntable 141 constitutes a positioner with azimuth axis AZ and elevation axis EL:

the turntable 141 turns horizontally about the axis AZ (see FIG. 4);

the EL axis (coinciding with the rotation axis 11, see FIG. 3) and movement about this axis is driven by the gear motor 14 is on the turntable 141.

Movement about the axis 11 is driven by the gear motor 14. There is no structural correlation between the source arm and the primary reflector. The AZ/EL positioner 141 serves as the interface between these two components. The cams 13 and the primary reflector 10 are secured to the axis 11 so that the angle α (see FIG. 7) formed by the cams 13 and the primary reflector 10 does not vary. The positioner 14 modifies the elevation of the antenna 10 (and the source arm 12) by rotation about the axis 11 by means of a system of gears 143 and a lead screw 143' (see FIG. 8*ter*).

The primary reflector 10, the source arm 12, and the EL axis drive system 14 are mounted on the horizontal turntable 141 that is turned about a vertical axis by the AZ axis drive system (not shown) to adjust the azimuth of the antenna 10. The turntable 141 is mounted on the base 2 via a ball bearing 142 (FIG. 4). The AZ axis drive system drives the turntable 141 in rotation via a system of toothed wheels (not shown).

An automatic pointing system can be provided for controlling the AZ, EL and POL axes so that the satellite mobile telecommunications station automatically points towards a preselected satellite.

The POL axis of an ad hoc positioner (not shown) mounted on the source arm enables the polarization of the antenna to be adjusted by turning the horn 123 about its revolution axis.

Because the high-voltage power supply unit for the TWT 125 is in the base 2, the forces to which the positioner 141 is subjected are lower than if this unit were on the source arm 12 and the positioner 141 and its AZ and EL axis drive systems can therefore be made smaller.

Figure 5:
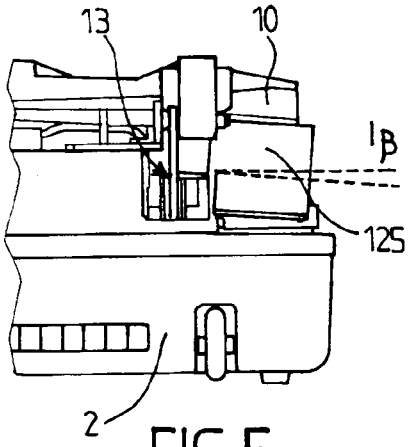
FIG. 5 is a view of the rear of the satellite mobile telecommunications station in the folded position, showing the inclination of the TWT of the present invention.
Figure 6:
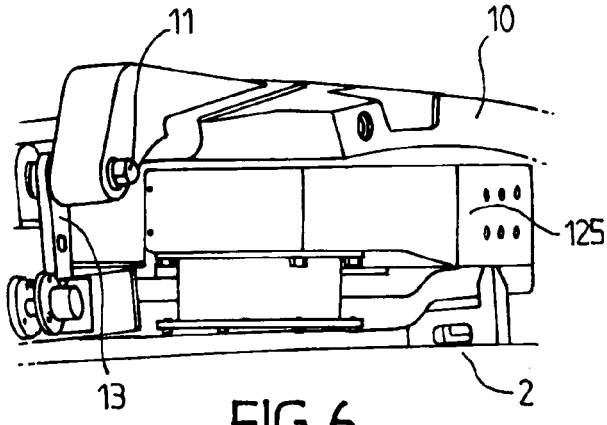
FIG. 6 is a view of a rear lateral corner showing the integration of the cam mechanism and the TWT from FIG. 5.

Referring to FIGS. 4 to 6, the TWT 125 is of substantially rectangular shape. It is positioned laterally on the source arm 12 on one of the two rectilinear arms 120' and extending towards the exterior of the source arm and is slightly inclined to the plane formed by the two arms 120' extending from the axis 11. This inclination allows the TWT 125 to fit optimally against the curvature of the primary reflector 10 in the folded position. This inclination β is of the order of 0 to 15°, preferably 5° to 10°. As shown in FIGS. 4 to 6, the position of the TWT 125 and its inclination enable it to occupy part of the space defined by the curvature of the primary reflector 10, making the station 1 more compact in the storage position.

The inclination of the TWT 125 is obtained by giving the arm 120' supporting the TWT 125 a right-angle trapezium profile (see FIG. 4), the inclined side of which (inclined at an angle β) corresponds to the upper surface of the arm 12 to which the TWT 125 is fixed. The TWT 125 is glued or screwed to the arm 120'.

The cams 13 and the resulting movement are described in more detail below with reference to FIGS. 7 to 12.

A cam 13 is fixed to each end of the arms 120' of the source arm 12 at the level of the pivots 11'. The cam 13 has:

two separate rotation axes: the first axis 11 coinciding with the rotation axis of the primary reflector 10 to enable packaging of the structure in the storage position and adjustment of elevation in use, and the second axis 130 for rotation of the source arm 12 relative to the cam 13;

an abutment area 131 which, in the position of use, is in permanent contact with a corresponding abutment 132 on the arm 120' to enable the drive system for the elevation axis 11 to drive the source arm 12 in rotation. In use, the source arm 12 is held cantilever fashion by the cams 13. In the examples shown in the figures, the abutments are provided on the side opposite the axis 11 relative to the axis 130; the abutment 132 on the arm 12 is above the abutment 131 on the cam 13 to counterbalance the weight of the source arm 12. Abutments can be provided between the two axes, the abutment 132 on the arm 120' then being below the abutment 131 on the cam 13;

retaining means 133 of the type with an oblong housing that accommodates a catch mechanism 134 provided at the end of the source arm 12. When the source arm 12 and the cam 13 are aligned (in the position of use), the catch mechanism 134, secured to the source arm 12, is engaged and gripped in the oblong housing 133 of the cam 13. Because of the oblong shape of the housing 133, the catch 134 does not prevent slight rotation of the source arm 12 relative to the cam 13. The force generated by a spring in the catch mechanism 134 defines the force with which the source arm 12 is retained by the cam 13. The catch mechanism 134 therefore has a retaining force greater than the weight of the source arm 12 when equipped and less than the force applied by an actuating mechanism for folding the antenna system. Accordingly, the cam can be folded again relative to the arm (by applying a force greater than the predefined value of the spring force) to reach the folded position of the system.

Typically, for high antenna elevations (large rotation about the axis 11, of the order of 85 to 90°, the source arm 12 can be quasi-vertical and the primary reflector 10 can be quasi-horizontal. The catch mechanism 124 therefore enables prevention of tilting of the source arm 12 towards the rear (towards the primary reflector) by wind or shock.

The role of the cam 13 is to allow packaging of the equipped source arm 12 in the stored position.

Figure 12:
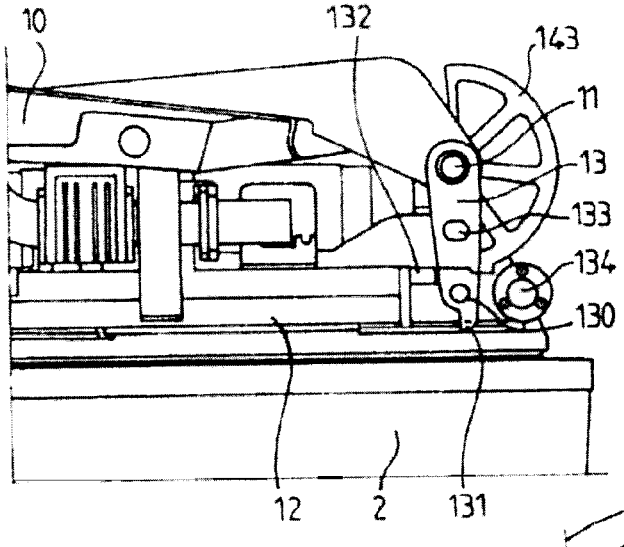
Figure 12A:
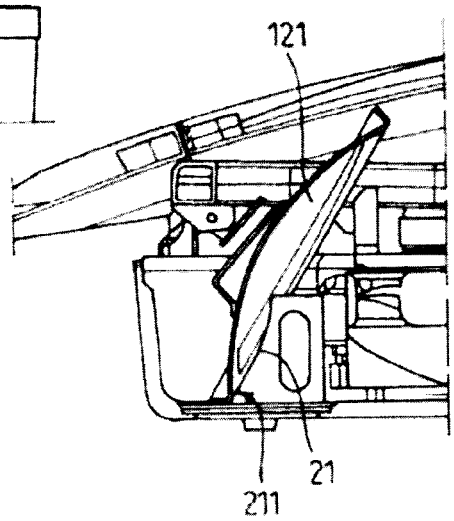

FIGS. 7 to 11 show the folding of the satellite mobile telecommunications station from the position of use (FIG. 7) to the packaging/storage position (FIG. 12).

Just before the cam 13 begins to function, the source arm 12 is at an acute angle to the horizontal (FIGS. 7-8) and rests on an abutment 15 secured to the base 2. This abutment 15 stops rotation of the source arm 12, whereas rotation about the axis 11 continues. When further rotation about the axis 11 starts folding of the satellite mobile telecommunications station, the abutment 15 prevents rotation of the arm 12, the force applied by the EL axis gear motor 14 about the axis 11 extracts the catch 134 from the corresponding oblong housing 133 and contact between the abutments 131 and 132 is immediately lost (see FIGS. 9 and 9*ter*). As soon as the cam 13 begins to function, it imparts to the source arm 12 a two-fold movement in vertical translation relative to the tilting/rotation point of the abutment 150, i.e. in the position of use:

upward movement on the side of the secondary mirror 121 (arrow F1, FIG. 9*bis*) for the portion of the source to the left of the abutment, because of the tilting/rotation about the abutment 150 (there being minimal front to rear movement); and downward movement on the side of the came 13 (arrow F2, FIG. 9*ter*);

thus imposing on the source arm a horizontal orientation (synonymous with a small overall size in the heightwise direction) by slight tilting of the arm 12 about the bearing point (or abutment) 15.

The cam 13 continues its rotation (arrow F3, FIG. 9*ter*) about the axis 11 and (the downward movement becoming minimal) imparts to the source arm 12 a front-to-rear movement (arrow F4, FIG. 10) by virtue of the arm 12 sliding on the abutment 15. This movement enables the arm 12 to end up under the mechanism of the positioner 14 to reduce the space required for storing the front end of the source arm 12. This makes the station more compact in the storage position.

The primarily horizontal movement in translation continues (FIG. 11), the cam 13 ending up in a vertical position (FIG. 12) corresponding to a horizontal folded arm 12 and a primary reflector 10 folded on top of the arm 12.

Fastener means are also provided for fastening the source arm 12 to the base 2 in the storage position to increase the resistance of the station to shock or vibration to which it may be subjected during transportation and handling. To this end, as shown in FIG. 7, a finger 16 is provided on the source arm 12, the end of the finger extending in the lengthwise direction of the arm 12 towards the cam 13. A housing 17 complementary to the finger 16 is provided on the base 2. As shown in FIG. 7, this housing 17 is formed in the bearing abutment 15 provided on the base 2.

Figure 13:
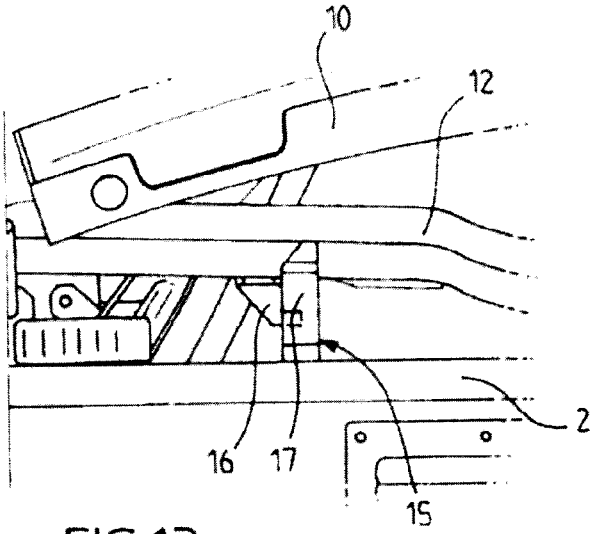
FIG. 13 is a view to a larger scale of the source arm fastening portion of the satellite mobile telecommunications station.

As shown in FIGS. 10*bis* and 11*bis*, during the primarily horizontal movement in translation imparted to the source arm 12 by the cam 13, the finger 16 approaches the housing 17 and then engages in the housing 17 to cooperate in fastening the arm 12 in the storage position (FIG. 13).

The fastener system (16, 17) is provided for both arms 120' of the source arm 12 to enable retention and immobilization of the source arm 12, which is a fundamental function when the satellite mobile telecommunications station is being transported or when it is mounted on a vehicle (drive-away).

Figure 7A:
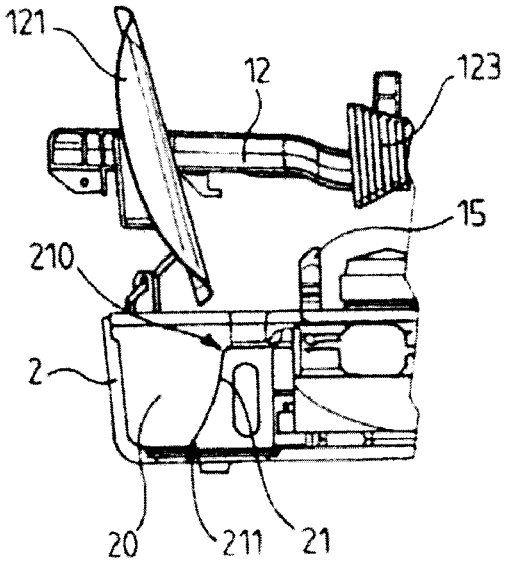
Figure 7:
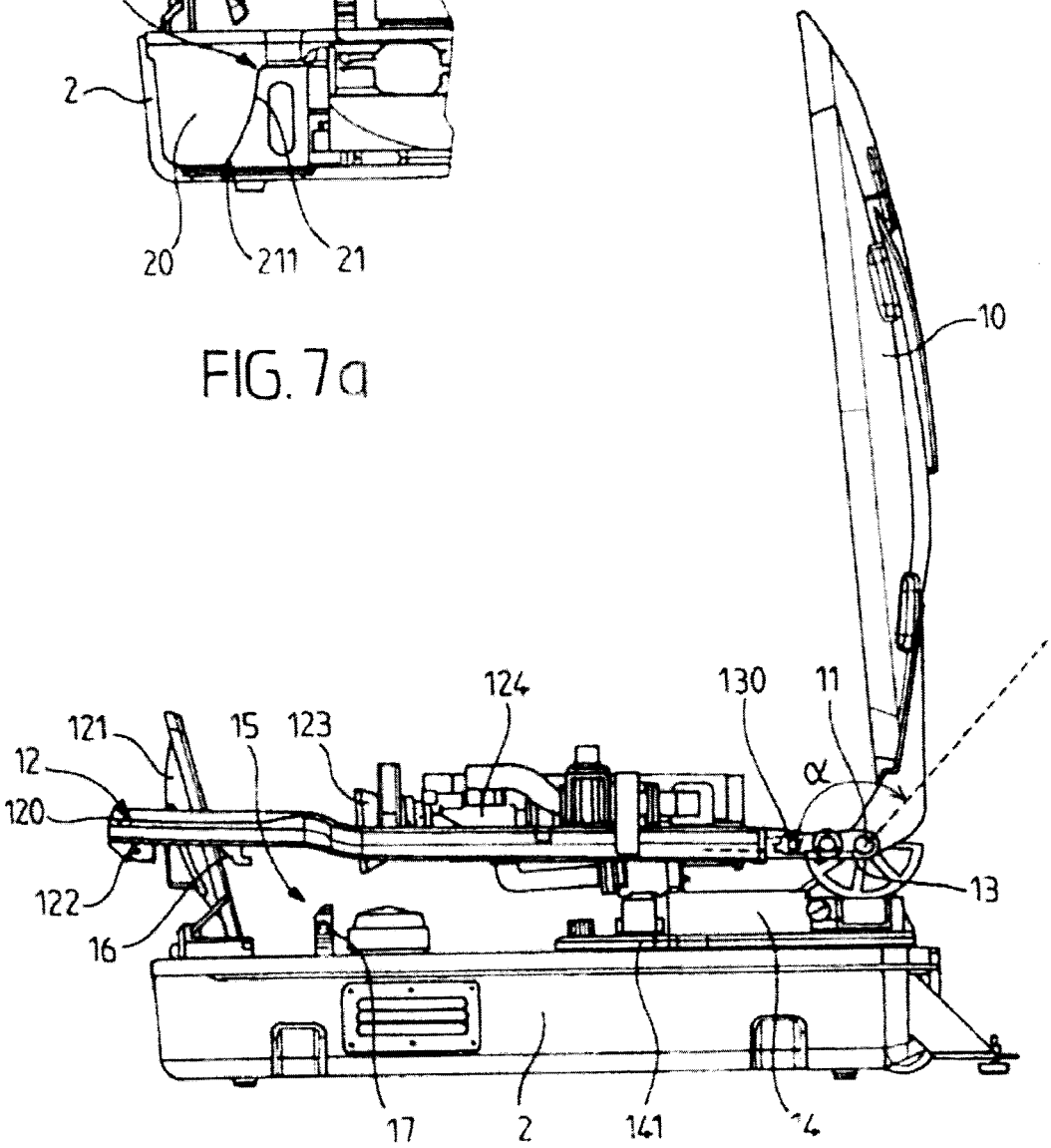
FIG. 7 is a lateral view of the satellite mobile telecommunications station from FIG. 2 in the operating position.

As indicated above, the secondary reflector 121 is articulated about the horizontal axis 122 (FIG. 7) which, in combination with the primarily horizontal movement in translation imparted to the source arm 12 by the cam 13, enables efficient storage of the reflector 121 in a housing 20 provided in the base 2 (see FIG. 7*bis*). The reflector 121 can thus be retracted into part of the space defined by the curvature of the primary reflector 10, making the satellite mobile telecommunications station more compact.

The housing 20 has a curved profile 21 between an upper point 210 substantially at the top of the base 2 and a lower point 211 substantially at the bottom of the base 2.

The mechanism for folding the secondary reflector 121 is described below with reference to FIGS. 7*bis* to 12*bis*, which are views in section to a larger scale of the area of the secondary reflector during the same folding steps as FIGS. 7 to 12.

When use of the station 1 ends, it is returned to the azimuth=0° and elevation=20° position shown in FIG. 7. In this position, the secondary reflector 121 is not in contact with the profile 21 (see FIG. 7*bis*).

The start of the folding phase, effected by rotation about the axis 11, brings the lower area of the secondary reflector 121 into contact with the upper point 210 of the profile 21 in the housing 20 (see FIG. 8*bis*).

During successive movements in translation in the downward direction (FIG. 9) and the rearward direction (FIGS. 10-11), the secondary reflector 121 slides along the guiding profile 21, turning about the axis 122. The effect of the horizontal movement in translation (see FIG. 10) is to bring the axis 122 towards the rear of the station 1 (on the same side as the axis 11), driving greater rotation of the secondary reflector 121 (see FIGS. 10*bis* and 11*bis*).

In the completely folded storage position (FIG. 12), the secondary reflector 121 is inclined at approximately 35°, the bottom of this reflector 121 being substantially level with the lower point 211 of the profile 21 (see FIG. 12*bis*).

This inclination can be modified by appropriately modifying the profile 21. An inclination is required that limits the horizontal extent of the secondary reflector 121 in the folded position and that tends to render the secondary reflector 121 parallel with the portion of the primary reflector 10 facing it in the storage position.

Although the above description is given with reference to folding the station 1, its unfolding can be deduced by taking the steps of FIGS. 7 to 12 in reverse order, from the last FIG. 12 to the first FIG. 7.

Thus the primarily horizontal movement in translation disengages the finger 16 from the housing 17.

When the cam 13 and the reflector 10 rotate about the axis 11, the catch 134 is engaged in the oblong housing 133 whereas the abutments 131 and 132 are not yet in contact. By means of the oblong shape of the housing 133, the rotation of the cam 13 continues to bring the two abutments into contact, by virtue of the rotation about the axis 11 and the positioner 14, the source arm 12 still resting on the bearing point 15. Once contact between the abutments has been established, the axis 11 drives the source arm 12 in rotation.

During the primarily horizontal movement in translation of the source arm 12, the secondary reflector 121 is rotated in the opposite direction by a return force produced by a spring provided at the level of the rotation axis 122, for example. An abutment (not shown) can equally be provided at the level of the secondary reflector 121 and the source arm 12 to define the position of use of the secondary reflector 121. The spring applies a contact force between the secondary reflector and the abutment to limit movement of the secondary reflector 121 in the presence of shock or vibration.

Figure 14:
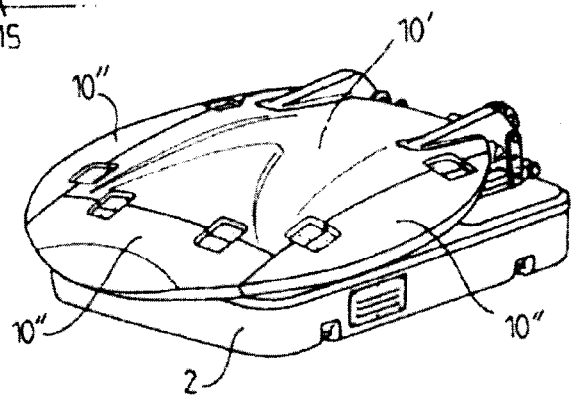
FIG. 14 shows in the folded position and with its primary reflector petals a satellite mobile telecommunications station adapted to be placed directly on the roof-rack of a motor vehicle.

The above station 1 can be mounted on a vehicle (see FIG. 14), with the base 2 fixed to a roof rack on the vehicle with no top lid 5. The aerodynamic shape of the primary reflector 10 fitted with its petals 10' and 10" in the folded storage position of the station 1 enables such use without serious risk of the station being damaged. The station is then unfolded into the position of use when the vehicle is stationary at the site of use.

The invention claimed is:

1. A mobile station comprising:

a satellite antenna for transmitting an electromagnetic signal;

a support;

a parabolic primary reflector;

a source arm; and high-power amplifier means for amplifying power of a signal transmitted by said satellite antenna, wherein said high-power amplifier means includes at least one traveling wave tube with a transmission power of at least 100 watts, said traveling wave tube being on said source arm; and a high-voltage power supply adapted to supply power to said traveling wave tube, said high-voltage power supply being located apart from said source arm on said support.

2. The mobile station according to claim 1, wherein said parabolic primary reflector and the source arm are mounted to move relative to a support between a position of use and a storage position.

3. The mobile station according to claim 2, wherein said traveling wave tube is arranged on said source arm so as to occupy in a storage position at least part of the space defined by the parabolic curvature of the primary reflector.

4. The mobile station according to claim 2, wherein said source arm is rotatably mounted on cam means secured to said primary reflector.

5. The mobile station according to the claim 4, wherein said cam means are such that said source arm effects a movement in translation on folding said primary reflector between said position of use and said storage position.

6. The mobile station according to claim 5, wherein the cam means comprise means for driving said source arm in rotation when said primary reflector is rotated relative to said support.

7. The mobile station according to claim 6, wherein said drive means further include retaining means adapted to maintain the relative position of said source arm and said cam means during use of said antenna.

8. The mobile station according to claim 5, further including a secondary reflector rotatably mounted on said source arm, said support including guide means adapted to guide said secondary reflector in rotation during said movement in translation of the source arm.

9. The mobile station according to claim 5, further including fastener means for fastening said source arm in the storage position.

10. The mobile station according to claim 9, wherein said fastener means include a first fastener member on said source arm and a second fastener member secured to said support, said first and second fastener members being adapted to cooperate with each other during said movement in translation of the source arm.

11. The mobile station according to claim 10, wherein said first fastener member includes at least one finger secured to said source arm and said second fastener member includes at least one opening formed in said support and adapted to receive said at least one finger during the movement in translation.

12. The mobile station according to claim 1, further comprising:

a lid removably engaged with said support said support and said lid being adapted to form a storage structure for said antenna in the storage position.

13. A mobile station comprising:

a satellite antenna for transmitting an electromagnetic signal;

a support;

a parabolic prima reflector;

a source arm, said parabolic primary reflector and the source arm are mounted to move relative to a support between a position of use and a storage position, wherein said source arm is rotatably mounted on cam means secured to said primary reflector, said cam means are such that said source arm effects a movement in translation on folding said primary reflector between said position of use and said storage position, said cam means comprise means for driving said source arm in rotation when said primary reflector is rotated relative to said support, where said drive means further include retaining means adapted to maintain the relative position of said source arm and said cam means during use of said antenna; and high-power amplifier means for amplifying power of a signal transmitted by said satellite antenna, wherein said high-power amplifier means includes at least one traveling wave tube with a transmission power of at least 100 watts, said traveling wave tube being on said source arm; and a high-voltage power supply adapted to supply power to said traveling wave tube, said high-voltage power supply being located apart from said source arm on said support.

14. A mobile station comprising:

a satellite antenna for transmitting an electromagnetic signal;

a support;

a parabolic primary reflector;

a source arm, said parabolic primary reflector and the source arm are mounted to move relative to a support between a position of use and a storage position, wherein said source arm is rotatably mounted on cam means secured to said primary reflector, said cam means are such that said source arm effects a movement in translation on folding said primary reflector between said position of use and said storage position;

a fastener means for fastening said source arm in the storage position, wherein said fastener means include a first fastener member on said source arm and a second fastener member secured to said support, said first and second fastener members being adapted to cooperate with each other during said movement in translation of the source arm, with said first fastener member including at least one finger secured to said source arm and said second fastener member includes at least one opening formed in said support and adapted to receive said at least one finger during the movement in translation; and high-power amplifier means for amplifying power of a signal transmitted by said satellite antenna, wherein said high-power amplifier means includes at least one traveling wave tube with a transmission power of at least 100 watts, said traveling wave tube being on said source arm; and a high-voltage power supply adapted to supply power to said traveling wave tube, said high-voltage power supply being located apart from said source arm on said support.

* * * * *

UNITED STATES PATENT AND TRADEMARK OFFICE

CERTIFICATE OF CORRECTION

PATENT NO. : 8,362,963 B2
APPLICATION NO. : 12/676249
DATED : January 29, 2013
INVENTOR(S) : Bruno Rakotoarisoa et al.

It is certified that error appears in the above-identified patent and that said Letters Patent is hereby corrected as shown below:

Column 13:
Claim 13 Line 42: “prima” should be “primary”

Signed and Sealed this
Twelfth Day of March, 2013

Teresa Stanek Rea
*Acting Director of the United States Patent and Trademark Office*